US011674110B2

(12) United States Patent
Hinden-Kuhles et al.

(10) Patent No.: US 11,674,110 B2
(45) Date of Patent: Jun. 13, 2023

(54) COMPOSITIONS CONTAINING LAURYL METHACRYLATE FOR MALODOR REDUCTION AND USES THEREOF

(71) Applicant: Agilex Flavors and Fragrances, Inc., Piscataway, NJ (US)

(72) Inventors: Natalie Hinden-Kuhles, Somerville, NJ (US); Mathias Guentert, Ridgewood, NJ (US); Thomas Siedel, West Caldwell, NJ (US); Alice Rebeck, Hillsborough, NJ (US); Viktoria Korosi, New York, NY (US); Nicole Oram, Raritan, NJ (US)

(73) Assignee: AGILEX FLAVORS AND FRAGRANCES, INC, Piscataway, NJ (US)

( * ) Notice: Subject to any disclaimer, the term of this patent is extended or adjusted under 35 U.S.C. 154(b) by 76 days.

(21) Appl. No.: 15/745,242

(22) PCT Filed: Jul. 16, 2016

(86) PCT No.: PCT/US2016/042690
§ 371 (c)(1),
(2) Date: Jan. 16, 2018

(87) PCT Pub. No.: WO2017/015173
PCT Pub. Date: Jan. 26, 2017

(65) Prior Publication Data

US 2020/0087596 A1 Mar. 19, 2020

Related U.S. Application Data

(60) Provisional application No. 62/194,063, filed on Jul. 17, 2015.

(51) Int. Cl.

| | |
|---|---|
| ***C11D 3/37*** | (2006.01) |
| ***C11D 3/00*** | (2006.01) |
| ***C11D 7/26*** | (2006.01) |
| ***C11D 17/04*** | (2006.01) |
| ***D06M 13/00*** | (2006.01) |
| ***D06M 13/224*** | (2006.01) |

(52) U.S. Cl.
CPC ..... *C11D 3/0068* (2013.01); *C11D 7/266* (2013.01); *C11D 17/047* (2013.01); *D06M 13/005* (2013.01); *D06M 13/2246* (2013.01)

(58) Field of Classification Search
CPC ..... C11D 11/0017; C11D 3/0068; C11D 3/48; C11D 3/50
See application file for complete search history.

(56) References Cited

U.S. PATENT DOCUMENTS

| | | | | |
|---|---|---|---|---|
| 2,544,093 | A * | 3/1951 | Kilgore | A61L 9/01 424/76.2 |
| 2,779,624 | A | 1/1957 | Friedman | |
| 4,083,954 | A * | 4/1978 | Tsuchiya | A61K 8/046 424/45 |
| 5,833,971 | A | 11/1998 | Baldwin | |
| 6,780,403 | B1 * | 8/2004 | Yamashita | A61K 8/0208 424/400 |
| 8,074,605 | B2 | 12/2011 | Hurwitz et al. | |
| 8,138,137 | B2 | 3/2012 | Leclerc et al. | |
| 2001/0028126 | A1 * | 10/2001 | Williams | A61L 15/46 264/103 |
| 2002/0032131 | A1 | 3/2002 | O'Connor | |
| 2004/0147416 | A1 * | 7/2004 | Woo | A61L 9/01 510/101 |
| 2009/0067760 | A1 * | 3/2009 | Shelley | B65D 81/28 383/109 |
| 2009/0127149 | A1 * | 5/2009 | Samarcq | B65D 5/4204 206/494 |
| 2012/0097754 | A1 | 4/2012 | Vlad et al. | |
| 2012/0183491 | A1 * | 7/2012 | Inoue | A61K 8/00 424/76.8 |

OTHER PUBLICATIONS

International Search Report and Written Opinion, application PCT/US2016/042690 dated Oct. 4, 2016.

* cited by examiner

*Primary Examiner* — Charles I Boyer

(57) ABSTRACT

Disclosed in certain embodiments are compositions for malodor reduction in fabric and methods for reducing malodor in fabric.

11 Claims, No Drawings

COMPOSITIONS CONTAINING LAURYL METHACRYLATE FOR MALODOR REDUCTION AND USES THEREOF

RELATED APPLICATIONS

This application is a national stage application under 35 U.S.C. § 371 filing of International Patent Application PCT/US2016/042690, filed Jul. 16, 2016, which claims the benefit of US Provisional patent application Ser. No. 62/194,063 filed Jul. 17, 2015. The contents of which are incorporated herein by reference in their entirety.

CROSS-REFERENCE TO RELATED APPLICATION

This application claims the benefit of priority of U.S. Provisional Patent Application Ser. No. 62/194,063, filed Jul. 17, 2015, the disclosure of which is hereby incorporated by reference herein in its entirety.

TECHNICAL FIELD

The present disclosure relates to compositions for malodor reduction, and in particular, the application of such compositions in laundry processes.

BACKGROUND

Clothing articles that have been exposed to sweat from the wearer during use develop malodor (e.g., a smell of sweat and other body odors) that is often difficult to remove by washing. Manufacturers of products for controlling/reducing malodor often utilize ingredients for malodor reduction that may be effective at reducing, but not necessarily eliminating, malodor. In certain products, scented perfumes are used to help mask malodors, however malodor may still remain and become noticeable once again after the potency of the scented perfume wears off.

SUMMARY

Embodiments of the present disclosure relate to malodor reducing and odor freshening compositions that include a malodor reducing component as well as freshening fragrance component. Some of the freshening fragrance components may also have a malodor reducing effect or work synergistically with the malodor reducing component. Methods of use thereof are also provided. Such odor improving compositions may be used to reduce malodor and boost the fresh odor in laundry applications, such as washing and drying in particular.

In certain embodiments, a composition for malodor reduction in fabric includes lauryl methacrylate and a freshening fragrance, which may contain fragrance components that may also help to reduce the malodor.

In certain embodiments, a method of reducing malodor in fabric includes applying a composition (e.g., one of the compositions described herein) for malodor reduction onto a fabric, washing the fabric, and drying the fabric.

In certain embodiments, a dryer sheet for reducing malodors from fabric includes a substrate having additives incorporated thereon. The additives include a malodor reducing component and a freshening fragrance component. For example, the malodor reducing component may be lauryl methacrylate. The freshening fragrance component may contain one or more components that further help to reduce the malodor.

In one aspect of the present disclosure, a composition for malodor reduction in fabric comprises (A) a malodor reducing component comprising lauryl methacrylate; and (B) a freshening fragrance component. In certain embodiments, the freshening fragrance component is selected from adoxal (2,6,10-trimethyl-9-undecenal), aldehyde C-8, aldehyde C-9, aldehyde C-10, aldehyde C-12, amyl salicylate, anisic aldehyde, benzyl salicylate, coumarin, bourgeonal (4-t-butylbenzenepropionaldehyde), lilial (2-methyl-4-t-butylphenyl)propanal), cinnamic aldehyde, citral, cyclal (2,4-dimethyl-3-cyclohexen-1-carbaldehyde), citrathal, citronitrile, cyclacet, cyclamal, cycloprop, cyclopentadecanone, delta-damascone, dihydromyrcenol, dihydromyrcenyl acetate, dimetol, florhydral (3-(3-isopropyl-phenyl)-butyraldehyde), citronellal (3,7-dimethyl 6-octenal), cymal, cyclamen aldehyde, cyclosal, dupical (tricyclodecylidenebutanal or 4-tricyclo-5.2.1.0.-2,6-decylidene-8-butanal), dynascone, ethyl linalyl acetate, ethyl vanillin, floralozone, florhydral, helional (alpha-methyl-3,4-(methylenedioxy)-hydrocinnamaldehyde), helvetolide, gamma-heptalactone, hexyl cinnamic aldehyde, alpha-ionone, hydrocinnamaldehyde (3-phenylpropanal, 3-phenylpropionaldehyde), hydroxycitronellal, Iso E Super, karanal, lime aldehyde (alpha-methyl-p-isopropyl phenyl propyl aldehyde), lyral (4-(4-hydroxy-4-methylpentyl)-3-cyclohexene-1-carboxaldehyde), manzanate, melonal (2,6-dimethyl-5-heptenal), methoxy melonal (6-methoxy-2,6-dimethylheptanal), gamma-methylionone, methyl naphtyl ketone, methyl salicylate, methyl nonyl acetaldehyde, musk ketone, musk galaxolide, gamma-nonalactone, ozonil, phenylacetaldehyde, scentenal, spirogalbanone, tetrahydrolinalyl acetate, tetrahydromyrcenol, trans-2-decenal, triplal, vernaldehyde, vertocitral (2,4-dimethyl-3-cyclohexene-1-carboxaldehyde), Verdox, yara yara, and combinations thereof.

In certain embodiments, the lauryl methacrylate is present from 1% to 50% by weight in the composition. In certain embodiments, the lauryl methacrylate is present from 1% to 10% by weight in the composition. In certain embodiments, the lauryl methacrylate is present in monomeric form.

In another aspect of the present disclosure, a method of reducing malodor in fabric comprises: applying a composition for malodor reduction onto a fabric, the composition comprising lauryl methacrylate; and drying the fabric. In certain embodiments, the method further comprises washing the fabric subsequent to applying the composition onto the fabric and prior to drying the fabric. In certain embodiments, the composition further comprises a freshening fragrance component selected from one of the aforementioned compounds and combinations thereof. In certain embodiments, the lauryl methacrylate is present in the composition in monomeric form.

In another aspect of the present disclosure, a dryer sheet for reducing malodors from fabric comprises: a substrate having additives incorporated thereon. In certain embodiments, the additives comprise: (A) a malodor reducing component comprising lauryl methacrylate; and (B) a freshening fragrance component. In certain embodiments, the freshening fragrance component is selected from one of the aforementioned compounds and combinations thereof. In certain embodiments, the lauryl methacrylate is present in monomeric form. In certain embodiments, the lauryl methacrylate is present in an amount from 1% to 50% by weight based on a total weight of the additives. In certain embodiments, the lauryl methacrylate is present in an amount from 1% to 10% by weight based on a total weight of the additives.

In another aspect of the present disclosure, a composition for malodor reduction in fabric comprises: (A) a malodor reducing component comprising lauryl methacrylate; and (B) a freshening fragrance component comprising one or more of aldehyde compounds, ketone compounds, or ester compounds. In certain embodiments, the lauryl methacrylate is present in monomeric form. In certain embodiments, the lauryl methacrylate is present from 1% to 50% by weight in the composition. In certain embodiments, the lauryl methacrylate is present from 1% to 10% by weight in the composition.

In certain embodiments, the freshening fragrance component comprises aldehyde compounds, ester compounds, and ketone compounds. In certain embodiments, the aldehyde compounds are present in an amount from 1% to 40% by weight based on a total weight of the freshening fragrance component, and the ester compounds are present in an amount from 15% to 50% by weight based on the total weight of the freshening fragrance component.

In certain embodiments, the ester compounds are present in an amount from 15% to 50% by weight based on a total weight of the freshening fragrance component, and the ketone compounds are present in an amount from 3% to 35% by weight based on the total weight of the freshening fragrance component.

In certain embodiments, the aldehyde compounds are present in an amount from 1% to 40% by weight based on a total weight of the freshening fragrance component, and the ketone compounds are present in an amount from 3% to 35% by weight based on the total weight of the freshening fragrance component.

In certain embodiments, the aldehyde compounds are present in an amount from 1% to 40% by weight based on a total weight of the freshening fragrance component, the ketone compounds are present in an amount from 3% to 35% by weight based on the total weight of the freshening fragrance component, and the ester compounds are present in an amount from 15% to 50% by weight based on the total weight of the freshening fragrance component.

In another aspect of the present disclosure, any of the compositions described herein may be incorporated into a solid or liquid scent booster.

In another aspect of the present disclosure, any of the compositions described herein may be incorporated into a solid or liquid laundry detergent.

In another aspect of the present disclosure, any of the compositions described herein may be incorporated into a solid or liquid fabric softener.

In another aspect of the present disclosure, any of the compositions described herein may be incorporated into a sprayable formulation.

For the purpose of the present disclosure, the terms "alkyl" and "hydrocarbon" as used alone or as part of another group refers to a straight- or branched-chain aliphatic hydrocarbon containing one to twelve carbon atoms (i.e., $C_{1-12}$ alkyl) or the number of carbon atoms designated (i.e., a $C_1$ alkyl such as methyl, a $C_2$ alkyl such as ethyl, a $C_3$ alkyl such as propyl or isopropyl, etc.). In one embodiment, the alkyl group is chosen from a straight chain $C_{1-10}$ alkyl group. In another embodiment, the alkyl group is chosen from a branched chain $C_{1-10}$ alkyl group. In another embodiment, the alkyl group is chosen from a straight chain $C_{1-6}$ alkyl group. In another embodiment, the alkyl group is chosen from a branched chain $C_{1-6}$ alkyl group. In another embodiment, the alkyl group is chosen from a straight chain $C_{1-4}$ alkyl group. In another embodiment, the alkyl group is chosen from a branched chain $C_{1-4}$ alkyl group. In another embodiment, the alkyl group is chosen from a straight or branched chain $C_{2-4}$ alkyl group. Non-limiting exemplary $C_{1-10}$ alkyl groups include methyl, ethyl, propyl, isopropyl, butyl, sec-butyl, tert-butyl, iso-butyl, 3-pentyl, hexyl, heptyl, octyl, nonyl, decyl, and the like. Non-limiting exemplary $C_{1-4}$ alkyl groups include methyl, ethyl, propyl, isopropyl, butyl, sec-butyl, tert-butyl, and iso-butyl.

For the purpose of the present disclosure, the term "amino" or "amine" as used alone or as part of another group refers to $—NH_2$.

As used herein, use of the term "compound" when preceded by a chemical group (e.g., "ketone compound", "ester compound", etc.) refers to a chemical compound containing at least one of the chemical group (e.g., a "ketone compound" may be any chemical compound containing at least one ketone group).

Some of the compounds disclosed herein may contain one or more asymmetric centers and may thus give rise to enantiomers, diastereomers, and other stereoisomeric forms. The present disclosure is meant to encompass the use of all such possible forms, as well as their racemic and resolved forms and mixtures thereof. The individual enantiomers can be separated according to methods known in the art in view of the present disclosure. When the compounds described herein contain olefinic double bonds or other centers of geometric asymmetry, and unless specified otherwise, it is intended that they include both E and Z geometric isomers. All tautomers are intended to be encompassed by the present disclosure as well.

The term "about," as used herein in connection with a measured quantity, refers to the normal variations in that measured quantity, as expected by the skilled artisan making the measurement and exercising a level of care commensurate with the objective of measurement and the precision of the measuring equipment.

DETAILED DESCRIPTION

Certain embodiments are directed toward a composition for malodor reduction in fabric, the composition including a malodor reducing component and a freshening fragrance component. It is generally accepted that malodors can be suppressed, molecularly modified, or integrated into the fragrance. The disclosed embodiments, by using a combination of malodor reducing components and freshening fragrance components with the potential of synergetic reactions, may be used to successfully reduce malodor.

In certain embodiments, the malodor reducing component includes n-dodecyl methacrylate (also referred to herein as lauryl methacrylate), which is commercially available as Neutrazine®. Lauryl methacrylate is commonly utilized as part of a polymeric or copolymeric composition (e.g., poly (lauryl methacrylate) in detergents). In certain disclosed embodiments, lauryl methacrylate is utilized in its monomeric form to reduce malodor.

In certain embodiments, lauryl methacrylate is present from 1% to 50% by weight in the composition. In certain embodiments, lauryl methacrylate is present from 1% to 40% by weight in the composition. In certain embodiments, lauryl methacrylate is present from 1% to 25% by weight in the composition. In certain embodiments, lauryl methacrylate is present from 1% to 15% by weight in the composition. In certain embodiments, lauryl methacrylate is present from 1% to 10% by weight in the composition. In certain embodiments, lauryl methacrylate is present from 1% to 7.5% by weight in the composition. In certain embodiments, lauryl methacrylate is present from 1% to 5% by weight in the composition.

In certain embodiments, lauryl methacrylate is present from 2% to 50% by weight in the composition. In certain embodiments, lauryl methacrylate is present from 5% to 50% by weight in the composition. In certain embodiments, lauryl methacrylate is present from 7.5% to 50% by weight in the composition. In certain embodiments, lauryl methacrylate is present from 10% to 50% by weight in the composition. In certain embodiments, lauryl methacrylate is present from 15% to 50% by weight in the composition. In certain embodiments, lauryl methacrylate is present from 25% to 50% by weight in the composition. In certain embodiments, lauryl methacrylate is present from 30% to 50% by weight in the composition. In certain embodiments, lauryl methacrylate is present from 35% to 50% by weight in the composition. In certain embodiments, lauryl methacrylate is present from 40% to 50% by weight in the composition. In certain embodiments, lauryl methacrylate is present from 45% to 50% by weight in the composition.

In certain embodiments, lauryl methacrylate is present from 10% to 25% by weight in the composition. In certain embodiments, lauryl methacrylate is present from 12.5% to 25% by weight in the composition. In certain embodiments, lauryl methacrylate is present from 15% to 25% by weight in the composition. In certain embodiments, lauryl methacrylate is present from 17.5% to 25% by weight in the composition. In certain embodiments, lauryl methacrylate is present from 20% to 25% by weight in the composition. In certain embodiments, lauryl methacrylate is present from 22.5% to 25% by weight in the composition.

In certain embodiments, lauryl methacrylate is present from 10% to 20% by weight in the composition. In certain embodiments, lauryl methacrylate is present from 12.5% to 15% by weight in the composition. In certain embodiments, lauryl methacrylate is present from 15% to 20% by weight in the composition. In certain embodiments, lauryl methacrylate is present from 17.5% to 20% by weight in the composition.

In certain embodiments, lauryl methacrylate is present from 5% to 15% by weight in the composition. In certain embodiments, lauryl methacrylate is present from 7.5% to 15% by weight in the composition. In certain embodiments, lauryl methacrylate is present from 10% to 15% by weight in the composition. In certain embodiments, lauryl methacrylate is present from 12.5% to 15% by weight in the composition.

In certain embodiments, lauryl methacrylate is present from 2% to 10% by weight in the composition. In certain embodiments, lauryl methacrylate is present from 3% to 10% by weight in the composition. In certain embodiments, lauryl methacrylate is present from 4% to 10% by weight in the composition. In certain embodiments, lauryl methacrylate is present from 5% to 10% by weight in the composition. In certain embodiments, lauryl methacrylate is present from 6% to 10% by weight in the composition. In certain embodiments, lauryl methacrylate is present from 7% to 10% by weight in the composition. In certain embodiments, lauryl methacrylate is present from 8% to 10% by weight in the composition. In certain embodiments, lauryl methacrylate is present from 9% to 10% by weight in the composition.

In certain embodiments, lauryl methacrylate is present from 1% to 9% by weight in the composition. In certain embodiments, lauryl methacrylate is present from 2% to 9% by weight in the composition. In certain embodiments, lauryl methacrylate is present from 3% to 9% by weight in the composition. In certain embodiments, lauryl methacrylate is present from 4% to 9% by weight in the composition. In certain embodiments, lauryl methacrylate is present from 5% to 9% by weight in the composition. In certain embodiments, lauryl methacrylate is present from 6% to 9% by weight in the composition. In certain embodiments, lauryl methacrylate is present from 7% to 9% by weight in the composition. In certain embodiments, lauryl methacrylate is present from 8% to 9% by weight in the composition.

In certain embodiments, lauryl methacrylate is present from 1% to 8% by weight in the composition. In certain embodiments, lauryl methacrylate is present from 2% to 8% by weight in the composition. In certain embodiments, lauryl methacrylate is present from 3% to 8% by weight in the composition. In certain embodiments, lauryl methacrylate is present from 4% to 8% by weight in the composition. In certain embodiments, lauryl methacrylate is present from 5% to 8% by weight in the composition. In certain embodiments, lauryl methacrylate is present from 6% to 8% by weight in the composition. In certain embodiments, lauryl methacrylate is present from 7% to 8% by weight in the composition.

In certain embodiments, lauryl methacrylate is present from 1% to 7% by weight in the composition. In certain embodiments, lauryl methacrylate is present from 2% to 7% by weight in the composition. In certain embodiments, lauryl methacrylate is present from 3% to 7% by weight in the composition. In certain embodiments, lauryl methacrylate is present from 4% to 7% by weight in the composition. In certain embodiments, lauryl methacrylate is present from 5% to 7% by weight in the composition. In certain embodiments, lauryl methacrylate is present from 6% to 7% by weight in the composition.

In certain embodiments, lauryl methacrylate is present from 1% to 6% by weight in the composition. In certain embodiments, lauryl methacrylate is present from 2% to 6% by weight in the composition. In certain embodiments, lauryl methacrylate is present from 3% to 6% by weight in the composition. In certain embodiments, lauryl methacrylate is present from 4% to 6% by weight in the composition. In certain embodiments, lauryl methacrylate is present from 5% to 6% by weight in the composition.

In certain embodiments, lauryl methacrylate is present from 1% to 5% by weight in the composition. In certain embodiments, lauryl methacrylate is present from 2% to 5% by weight in the composition. In certain embodiments, lauryl methacrylate is present from 3% to 5% by weight in the composition. In certain embodiments, lauryl methacrylate is present from 4% to 10% by weight in the composition.

In certain embodiments, lauryl methacrylate is present from 1% to 4% by weight in the composition. In certain embodiments, lauryl methacrylate is present from 2% to 4% by weight in the composition. In certain embodiments, lauryl methacrylate is present from 3% to 4% by weight in the composition. In certain embodiments, lauryl methacrylate is present from 1% to 4% by weight in the composition. In certain embodiments, lauryl methacrylate is present from 2% to 4% by weight in the composition. In certain embodiments, lauryl methacrylate is present from 3% to 4% by weight in the composition. In certain embodiments, lauryl methacrylate is present from 1% to 3% by weight in the composition. In certain embodiments, lauryl methacrylate is present from 2% to 3% by weight in the composition. In certain embodiments, lauryl methacrylate is present from 1% to 2% by weight in the composition.

In certain embodiments, the freshening fragrance component includes one or more fragrance compounds, which may include mixtures of volatile aldehydes, esters, ketones, alcohols, lactones, ethers, hydrocarbons, nitriles, and other chemical classes. It is known that volatile aldehydes can neutralize malodors in the vapor and/or liquid phases via chemical reactions. Volatile aldehydes may react with amine-based odors, following the path of Schiff-base formation. Volatile aldehydes may also react with sulfur-based odors, forming thiol acetals, hemi-thiol acetals, and thioesters in the vapor and/or liquid phases. Alcohols may react chemically with malodorous aldehydes. In addition, many aldehydes and other fragrance materials are also strong odorants that may help to mask the malodorous components and hence help to freshen the smell of washed and dried fabrics.

Exemplary volatile fragrance materials which may be used as a malodor freshening component include, but are not limited to, adoxal (2,6,10-trimethyl-9-undecenal), aldehyde C-8, aldehyde C-9, aldehyde C-10, aldehyde C-12, amyl salicylate, anisic aldehyde, benzyl salicylate, coumarin, bourgeonal (4-t-butylbenzenepropionaldehyde), lilial (2-methyl-4-t-butylphenyl)propanal), cinnamic aldehyde, citral, cyclal (2,4-dimethyl-3-cyclohexen-1-carbaldehyde), citrathal, citronitrile, cyclacet, cyclamal, cycloprop, cyclopentadecanone, delta-damascone, dihydromyrcenol, dihydromyrcenyl acetate, dimetol, florhydral (3-(3-isopropylphenyl)-butyraldehyde), citronellal (3,7-dimethyl 6-octenal), cymal, cyclamen aldehyde, cyclosal, dupical (tricyclodecylidenebutanal or 4-tricyclo-5.2.1.0.-2,6-decylidene-8-butanal), dynascone, ethyl linalyl acetate, ethyl vanillin, floralozone, florhydral, helional (alpha-methyl-3,4-(methylenedioxy)-hydrocinnamaldehyde), helvetolide, gamma-heptalactone, hexyl cinnamic aldehyde, alpha-ionone, hydrocinnamaldehyde (3-phenylpropanal, 3-phenylpropionaldehyde), hydroxycitronellal, Iso E Super, karanal, lime aldehyde (alpha-methyl-p-isopropyl phenyl propyl aldehyde), lyral (4-(4-hydroxy-4-methylpentyl)-3-cyclohexene-1-carboxaldehyde), manzanate, melonal (2,6-dimethyl-5-heptenal), methoxy melonal (6-methoxy-2,6-dimethylheptanal), gamma-methylionone, methyl naphtyl ketone, methyl salicylate, methyl nonyl acetaldehyde, musk ketone, musk galaxolide, gamma-nonalactone, ozonil, phenylacetaldehyde, scentenal, spirogalbanone, tetrahydrolinalyl acetate, tetrahydromyrcenol, trans-2-decenal, triplal, vernaldehyde, vertocitral (2,4-dimethyl-3-cyclohexene-1-carboxaldehyde), Verdox, and yara yara, as well as combinations thereof.

In certain embodiments, the freshening fragrance component comprises one or more of aldehydes, esters, or alcohols. In certain embodiments, the one or more of aldehydes, esters, or alcohols are present from 1% to 95% by weight in the composition. In certain embodiments, the one or more of ketones or hydrocarbons are present from 1% to 75% by weight in the composition. In certain embodiments, the one or more of ketones or hydrocarbons are present from 1% to 60% by weight in the composition. In certain embodiments, the one or more of ketones or hydrocarbons are present from 1% to 50% by weight in the composition. In certain embodiments, the one or more of ketones or hydrocarbons are present from 1% to 40% by weight in the composition. In certain embodiments, the one or more of ketones or hydrocarbons are present from 1% to 30% by weight in the composition. In certain embodiments, the one or more of ketones or hydrocarbons are present from 1% to 25% by weight in the composition. In certain embodiments, the one or more of ketones or hydrocarbons are present from 1% to 20% by weight in the composition. In certain embodiments, the one or more of ketones or hydrocarbons are present from 1% to 15% by weight in the composition. In certain embodiments, the one or more of ketones or hydrocarbons are present from 1% to 10% by weight in the composition. In certain embodiments, the one or more of ketones or hydrocarbons are present from 1% to 5% by weight in the composition.

In certain embodiments, the one or more of ketones or hydrocarbons are present from 50% to 90% by weight in the composition. In certain embodiments, the one or more of ketones or hydrocarbons are present from 55% to 90% by weight in the composition. In certain embodiments, the one or more of ketones or hydrocarbons are present from 60% to 90% by weight in the composition. In certain embodiments, the one or more of ketones or hydrocarbons are present from 65% to 90% by weight in the composition. In certain embodiments, the one or more of ketones or hydrocarbons are present from 70% to 90% by weight in the composition. In certain embodiments, the one or more of ketones or hydrocarbons are present from 75% to 90% by weight in the composition. In certain embodiments, the one or more of ketones or hydrocarbons are present from 80% to 90% by weight in the composition. In certain embodiments, the one or more of ketones or hydrocarbons are present from 85% to 90% by weight in the composition.

Without being bound by theory, it is believed that the ratio of the fragrance components with certain functional groups plays a role in their effectiveness. In general aldehyde compounds, ketone compounds, and ester compounds may be particularly effective functional groups to aid the reduction of malodor. Alcohol compounds, lactone compounds, and ether compounds may also be effective. In certain embodiments, a significant malodor reduction was achieved with the following amounts: aldehydes (1-40%), esters (15-50%), and ketones (3-35%), with each calculated with respect to a total weight of the composition. It is to be understood that the amounts of each may be selected such that a total weight percent is equal to or less than 100% (e.g., a formulation that contains 40% aldehydes by weight and 50% esters by weight will have no greater than 10% ketones by weight).

In certain embodiments, aldehyde compounds are present from 15% to 40% by weight in the composition. In certain embodiments, aldehyde compounds are present from 12% to 38% by weight in the composition. In certain embodiments, aldehyde compounds are present from 25% to 35% by weight in the composition. In certain embodiments, a liquid formulation may be prepared by combining a first composition comprising aldehyde compounds present from 12% to 38% by weight in the first composition and a second composition comprising aldehyde compounds present from 1% to less than 12% by weight in the second composition. The first and second compositions may each comprise lauryl methacrylate in various quantities along with one or more of aldehyde compounds, ketone compounds, ester compounds, ether compounds, lactone compounds, alcohol compounds, or combinations thereof. The first and second compositions may together be combined with other compositions (e.g., a laundry detergent, a fabric softener, etc.) to produce the liquid formulation. It is believed that the first composition has a significant malodor reducing effect in damp laundry after a washing step, and that the second composition has a significant malodor reducing effect in dry laundry after a drying step, and that the combination of the two prior to laundry treatment may have a synergistic malodor reducing effect.

In certain embodiments, ester compounds are present from 25% to 50% by weight in the composition. In certain embodiments, ester compounds are present from 25% to 40% by weight in the composition. In certain embodiments, ester compounds are present from 25% to 30% by weight in the composition. In certain embodiments, ester compounds are present from 30% to 50% by weight in the composition. In certain embodiments, ester compounds are present from 30% to 40% by weight in the composition.

In certain embodiments, ketone compounds are present from 1% to 10% by weight in the composition. In certain embodiments, ketone compounds are present from 25% to 35% by weight in the composition. In certain embodiments, ketone compounds are present from 10% to 25% by weight in the composition.

In certain embodiments, ether compounds, lactone compounds, and alcohol compounds are present together from 1% to 30% by weight in the composition.

In certain embodiments, ether compounds and acetyl compounds are present together from 1% to 30% by weight in the composition. In certain embodiments, ether compounds and acetyl compounds are present together from 2% to 30% by weight in the composition. In certain embodiments, ether compounds and acetyl compounds are present together from 5% to 30% by weight in the composition. In certain embodiments, ether compounds and acetyl compounds are present together from 1% to 20% by weight in the composition. In certain embodiments, ether compounds and acetyl compounds are present together from 1% to 10% by weight in the composition.

In certain embodiments, alcohol compounds and lactone compounds are present together from 1% to 30% by weight in the composition. In certain embodiments, alcohol compounds and lactone compounds are present together from 2% to 30% by weight in the composition. In certain embodiments, alcohol compounds and lactone compounds are present together from 5% to 30% by weight in the composition. In certain embodiments, alcohol compounds and lactone compounds are present together from 1% to 20% by weight in the composition. In certain embodiments, alcohol compounds and lactone compounds are present together from 1% to 10% by weight in the composition.

It is noted that various combinations of each of the disclosed ranges for any of the aldehyde compounds, ketone compounds, ester compounds, ether compounds, lactone compounds, alcohol compounds, and acetyl compounds are compatible and contemplated for any of the disclosed embodiments.

In certain embodiments, the freshening fragrance component comprises one or more of phenols, nitrogen-based compounds, or sulfur-based compounds, and wherein the one or more of phenols, nitrogen-based compounds, or sulfur-based compounds are present at less than 1% by weight in the composition.

In certain embodiments, the freshening fragrance component comprises one or more components selected from acetophenone, 2,6,10-trimethyl-9-undecenal, acetanisole, hexanal, heptanal (aldehyde C7), 2-methyldecanal (aldehyde MOA), 10-undecenal, undecanal, 2-methylundecanal, ethyl methylphenylglycidate, gamma-nonalactone, allyl (3-methylbutoxy)acetate, allyl hexanoate (allyl caproate), allyl cyclohexylpropionate, allyl heptanoate, 1-(2-butyl cyclohexyloxy)-2-butanol, dodecahydro-3,8,8,11a-tetramethyl-5H-3,5a-epoxynaphth[2,1-c]oxepin, 5-cyclohexadecen-1-one, 4H-4a,9-methanoazuleno[5,6-d]-1,3-dioxole,octahydro-2,2,5,8,89a-hexamethyl-,(4aR,5R,7aS,9R)-, ambroxan (ambroxid), "1,5,5,9-tetramethyl-13-oxatricyclo,(8.3.0.0(4,9))tridecane", amyl salicylate, oxacycloheptadec-10-ene-2-one, trans-anethole [(E)-anethole], p-methoxybenzaldehyde, phenylethyl isoamyl ether, artemisia oil, 1,2,3,4,4a,5,6,7-octadhydro-2,5-trimethyl-2-naphthol, 1-cyclocitronellene formate, basil oil (*Ocimum basilicum* L.), benzaldehyde, benzonitrile, benzophenone, benzyl acetate, benzyl benzoate, benzyl butyrate, benzyl isobutyrate, octahydrocoumarin, formaldehyde cyclododecyl ethyl acetal, 2-ethoxy-2,6,6-trimethyl-9-methylenebicyclo[3.3.1]nonane, p-tert-butyldihydrocinnamaldehyde, 1-borneol, butyl acetate, 2-ethyl-4-(2,2,3-trimethyl-3-cyclopenten-1-yl)-2-buten-1-ol, 7-methyl-2H-benzo-1,5-dioxepin-3(4H)-one (Calone), ethyl 2-methyl-4-oxo-6-pentylcyclohex-2-ene-1-carboxylate, camphene, camphor, 1-carvone, 6,7-dihydro-1,1,2,3,3-pentamethyl-4(5H)-indanone (Cashmeran), cedar leaf oil (*Thuja occidentalis* L.), cedarwood oil, cedrol crystals, cedrol methyl ether, cedarwood oil terpenes, 4-acetyl-6-t-butyl-1,1-dimethylindan (Celestolide), cinnamyl nitrile, cinnamyl alcohol, cinnamaldehyde, cinnamyl acetate, citral, 2,6-octadienal, 3,7-dimethyl-(reaction products with EtOh), citronellal, dl-citronellol, citronellyl acetate, citronellyl nitrile, (E)-3-methyl-5-phenylpent-2-enenitrile, patchouli extract, coumarin, cuminyl nitrile, cuminaldehyde, 2-methyl-3-(p-isopropylphenyl)propionaldehyde, allyl (cyclohexyloxy)acetate, octahydro-8,8-dimethylnaphthalene-2-carbaldehyde (Cyclomeral), cyclopentadecanone, 3a,4,5,6,7,7a-hexahydro-4,7-methano-1H-inden-5-yl isobutyrate (=tricyclodecenyl-8-isobutyrate), acetoxydihydrodicyclopentadiene, tricyclodecanyl acetate, 3a,4,5,6,7,7a-hexahydro-4,7-methano-1H-indenyl propionate (mixture of isomers), 1-(2,6,6-trimethylcyclohexa-1,3-dienyl)-2-buten-1-one (damascenone), (2E)-1-(2,6,6-trimethyl-1-cyclohexen-1-yl)-2-buten-1-one, trans-alpha-1-(2,6,6-trimethyl-2-cyclohexen-1-yl)-2-buten-1-one (trans-alphadamascone), delta-1-(2,6,6-trimethyl-3-cyclohexen-1-yl)-2-buten-1-one (delta-damascone), (E)-2-decenal, cis-4-decen-1-al, (E)-4-decenal, gamma-decalactone, diethyl malonate, octanenitrile, 3,7-dimethyl-, methyl hexyl oxo cyclopentanone carboxylate, 3-methyl-2-(n-pentanyl)-2-cyclopenten-1-one, dihydromyrcenol, dihydromyrcenyl acetate, d-limonene ((R)-p-mentha-1,8-diene), methyl N-methylanthranilate, 1,1-dimethyl-2-phenylethyl acetate, 1,1-dimethyl-2-phenylethyl isobutyrate, 2,6-dimethyl-2-heptanol, diphenyl ether, 2-dodecenal, 4-tricyclodecylidene butanal (dupical), 1-(5,5-dimethyl-1-cyclohexen-1-yl)pent-4-en-1-one, acetaldehyde ethyl phenyl ethyl acetal, acetaldehyde ethyl linalyl acetal, 3-methyl-5-(2,2,3-trimethyl-3-cyclopenten-1-yl)pent-4-en-2-ol, ethylene brassylate, ethyl acetate, ethyl acetoacetate, 3-octanone, ethyl butyrate, ethyl hexanoate, 3,7-dimethyl-1,6-nonadien-3-ol, ethyl 2-methylbutyrate, ethyl propionate, ethyl safranate (ethyl 2,6,6-trimethylcyclohexa-2,4-diene-1-carboxylate), ethyl vanillin, eucalyptol, eucalyptus oil (*Eucalyptus globulus* labille), eugenol, fenchyl alcohol, 2-methyl-4-(2,2,3-trimethyl-3-cyclopenten-1-yl)-4-penten-1-ol, benzenepropanenitrile, 4-ethyl-a,a-dimethyl-, isopropylphenylbutanal, tetrahydro-2-isobutyl-4-methyl-pyran-4-ol, alpha,alpha-dimethyl-p-ethylphenylpropanal, ethyl 2,4-dimethyldioxolane-2-acetate, ethyl 2-methyl-1,3-dioxolane-2-acetate (fructone), 4,7-methano-3aH-indene-3a-carboxylic acid, octahydro-, ethyl ester, 2-methyldecanenitrile, 1,3,4,6,7,8-hexahydro-4,6,6,7,8,8-hexamethylcyclopenta-gamma-2-benzopyran (HHCB), geraniol, geranium oil, bourbon, geranyl acetate, cyclohexadec-8-en-1-one mixture of cis and trans isomer, 3-pentanone, 1-(2,6,6-trimethyl-2-cyclohexen-1-yl)-, reaction products with 2-propyn-1-ol (grisalva), oxacyclohexadecen- 2-one, methyl dihydrojasmonate, α-methyl-1,3-benzodioxole-5-propionaldehyde, 2-(1-(3',3'-dimethyl-1'-cyclohexyl) ethoxy)-2-methyl propyl propanoate, piperonal, bicyclo [2.2.1]hept-5-ene-2-carboxylic acid, 3-(1-methylethyl)-, ethyl ester, (2-, 1-(3,3-dimethylcyclohexy)ethan-1-one, gamma-heptalactone, hexadecanolide, allyl α-ionone, cis-3-hexenyl benzoate, cis-3-hexenyl salicylate, hexyl acetate, alpha-hexylcinnamaldehyde, 2-phenylpropionaldehyde dimethyl acetal, vetiveryl acetate, hydroxycitronellal, isocamphenyl cyclohexanol (mixed isomers), α-methylenebenzyl acetate, 4,4a,5,9b-tetrahydroindeno[1,2-d]-1,3-dioxine, undecylenic aldehyde (mixed isomers), alpha-ionone, beta-ionone, nonen acid nitrile, isobomeol, isobornyl acetate, quinolone ((2-methylpropyl)-), isobutyl phenylacetate, 3-(5,5,6-trimethylbicyclo[2.2.1]hept-2-yl)cyclohexan-1-ol, isoeugenol, 1-(1,2,3,4,5,6,7,8-octahydro-2,3,8,8-tetramethyl-2-naphthalenyl)ethanone (OTNE), 6-isopropylquinoline, 4-acetoxy-3-pentyltetrahydropyran, jasmone, 2-methyl-3-tolylpropionaldehyde, cyclopropanemethanol, 1-methyl-2-[(1,2,2-trimethylbicyclo[3.1.0]hex-3-yl) methyl], 2-(2,4-dimethyl-3-cyclohexen-1-yl)-5-methyl-5-(1-methylpropyl)-1,3-dioxane), 2(3H)-benzofuranone,hexahydro-3,6-dimethyl-, lavandin oil (*Lavandula hybrida*), cis-3-hexen-1-yl acetate, cis-3-hexenol, trans-2-hexenal, lemon oil, 3,7-dimethyl-2,6-nonadienenitrile, cis-3-hexenyl methyl carbonate, 1,6-octadien-3-ol, 7-dimethyl-,acid-isomerized, linalool, 2-(tetrahydro-5-methyl-5-vinyl-2-furyl)propan-2-ol, linalyl acetate, 3 and 4-(4-hydroxy-4-methylpentyl)-3-cyclohexene-1-carboxaldehyde, β,β,3-Trimethyl benzenepropanol, ethyl 2-methylpentanoate, cis-p-menthan-7-ol, 2,6-dimethyl-5-heptenal, octahydro-4,7-methano-1H-indenecarbaldehyde, menthol racemic, 2-trans-dodecenal, methoxycitronellal, 4-(p-methoxyphenyl)-2-butanone, menthyl acetate (isomer unspecified), 4'-methylacetophenone, 2-heptanone (methyl-n-amyl ketone), methyl anthranilate, methyl benzoate, estragole (methyl chavicol) (NFS), methyl cinnamate, alpha-methylcinnamaldehyde, methyl 2-octynoate (methyl heptine carbonate), 2-nonanone, 2-octanone, methyl-a-ionone, alpha-iso-methylionone, methyl isoeugenol (isoeugenyl methyl ether), methyl 3-oxo-3-(penta-2-enyl)cyclopentaneacetate, 1-oxaspiro[4.5]decan-2-one,8-methyl-,cis-, methyl lavender ketone (component 1-1-hydroxy-3-decanone), 2-undecanone, 4-Hydroxy-3-methyloctanoic acid lactone, methyl 2-nonynoate (Methyl octine carbonate), methyl salicylate, methyl atrarate, 3-methylcyclopentadecenone, musk ketone, isohexenyl cyclohexenyl carboxaldehyde (vertomugal), 2-(p-menth-1-ene-10-yl)cyclopentanone, methyl 2-nonenoate, butanoic acid, 3a,4,5,6,7,7a-hexahydro-4,7-methano-1H-indenyl ester, nerol, nerol oxide, beta-naphthyl ethyl ether (nerolin bromelia), 1-(3-methyl-2-benzofuranyl)ethanone (nerolione), neryl acetate, nona-2-trans-6-cis-dienal, 2,6-nonadienal diethyl acetal, 2,6-nonadien-1-ol, 6,8-dimethylnonan-2-ol, nopol, nopyl acetate, gamma-octalactone, orange peel oil (*Citrus sinensis* (L.) *osbeck*), 4-(1-methoxy-1-methylethyl)-1-methylcyclohexene, methyl beta-naphthyl ketone, (2-acetonaphthone), 4-t-amylcyclohexanone, orris absolute (*Iris pallida*), cis-2-methyl-4-propyl-1,3-oxathiane, 4-(p-hydroxyphenyl)-2-butanone (p-hydroxybenzyl acetone), tridecene-2-nitrile, p-methylanisole, p-cymene, 2-ethyl-N-methyl-N-(3-methylphenyl)butanamide, p-tolualdehyde, 4-tert-butylcyclohexanol, patchouly oil, alpha-cyclohexylidene benzeneacetonitrile (Peonile), peppermint oil, (2-isopropoxyethyl)benzene (petiole), petitgrain mandarin oil (*Citrus reticulata blanco* var. *mandarin*), 3-methyl-5-phenylpentanol, 2-phenoxyethanol, 2-phenoxyethyl isobutyrate, phenethyl acetate, phenylethyl alcohol, phenethyl salicylate, 3-phenyl-1-propanol, 3-phenylpropionaldehyde, isolongifolene ketone, pine oil, 6,6-dimethylbicyclo[3.1.1] hept-2-ene-2-propionaldehyde, a-pinene, β-pinene, tricyclodecenyl-8-pivalinate, "3,3-dimethyl-5-(2,2,3-trimethyl-3-cyclopenten-, 1-yl)-4-penten-2-ol", 2,6,10-trimethylundeca-5,9-dienal, 2,4-dimethyl-4-phenyltetrahydrofuran, 3,4,4a,5,8,8a-hexahydro-3',7-dimethylspiro[1,4-methanonaphthalene-2(1H),2'-oxirane] (Rhubofix), methyl-2,2-dimethyl-6-methylene-1-cyclohexanecarboxylate, 9-decen-1-ol, rosemary oil (*Rosmarinus officinalis* L.), trichloromethyl phenyl carbinyl acetate, 2,3,3-trimethylindanone, 2,6,6-trimethylcyclohexa-1,3-dienyl methanal, 5-(2,2,3-trimethyl-3-cyclopentenyl)-3-methylpentan-2-ol, methoxy dicyclopentadiene carboxaldehyde, sclareol, p-isobutyl-alpha-methyl hydrocinnamaldehyde, orange peel extract (*Citrus sinensis* L. *osbeck*), spearmint oil (Chinese), 5-methyl-3-heptanone oxime, alpha-methylbenzyl acetate, methyl phenyl carbinol (Styrallyl alcohol), gamma-terpinene, alpha-terpineol, 4-carvomenthenol, terpinolene, terpinyl acetate (Isomer mixture), tetrahydrolinalool, tetrahydromyrcenol (2,6-Dimethyl-2-octanol), tetrahydrolinalyl acetate, tetrahydromuguol, p-Mentha-8-thiol-3-one, thiogeraniol, 1-(2,2,6-trimethylcyclohexyl)-3-hexanol, 6-acetyl-1,1,2,4,4,7-hexamethyltetraline (tonalide, fixolide, AHTN), 1-cyclopropylmethyl-4-methoxybenzene, tridecanal, 2-tridecenal, acetic acid, anhydride, reaction products with 1,5,10-trimethyl-1,5,9-cyclododec, dimethylcyclohex-3-ene-1-carboxaldehyde (dimethyl tetrahydrobenzaldehyde), 2H-indeno[4,5-b] furan, decahydro-2,6,6,7,8,8,-hexamethyl, 1,3,5-undecatriene, 4-methyl-3-decen-5-ol, 2-methoxy-4-methylphenol (creosol), vanillin isobutyrate, vanillin, 2,2,5-trimethyl-5-pentylcyclopentanone, maltol, ethyl maltol, 2-tert-butyl cyclohexanone, 2-tert-butylcyclohexyl acetate, acetyl cedrene, 4-tert-butylcyclohexyl acetate, 1,3-undecadien-5-yne, psoralen, phenylacetaldehyde dimethyl acetal, 2-methoxynaphthalene (beta-naphthyl methyl ether, nerolin, yara yara), 4,7,7-trimethyl-6-thiabicyclo [3.2.1]octane, and combinations thereof.

ILLUSTRATIVE EXAMPLES

The following illustrative examples provide experimental conditions for washing and drying trials with malodor reducing compositions, in accordance with some of the embodiments described herein. The examples set forth to assist in understanding the disclosure and should not, of course, be construed as specifically limiting the embodiments described and claimed herein. Such variations of the disclosed embodiments, including the substitution of all equivalents now known or later developed, which would be within the purview of those skilled in the art, and changes in formulation or minor changes in experimental design, are to be considered to fall within the scope of the disclosed embodiments incorporated herein.

In the examples that follow, synthetic malodor compositions were utilized, which included between 8 and 12 malodorous components in various combinations selected from the chemical substance classes of short chain aliphatic and aromatic branched and unbranched fatty acids, short chain branched aldehydes, sulfur components, indole, and the steroid androstenone (a compound known to occur in human sweat and urine). The purpose of this malodor composition is not necessarily to mimic a specific body odor (such as sweat from under arm or foot), but rather to provide a model of well known malodorous substance classes that can be used as a uniform model of a generic overall malodor. The target components in dirty laundry may mainly include body odor, but environmental malodors (e.g., household, food, cigarette smoke, etc.) may also play a role.

Example 1: Malodor Reduction in Washing

A synthetic malodor composition was applied to the center of towels (white, 100% cotton washcloths 30 cm×30 cm) in various concentrations (0.8 to 1.0 grams per towel) for testing. The towels were washed in typical U.S. front-loading household washing machines (medium load is 40 towels) with various unscented detergents containing various concentrations of different malodor reducing and freshening compositions (typically applied at 1% into the detergent). After the washing cycle was finished, panels of at least 20 experienced panelists (sensorially skilled panelists) were asked to smell into the washing machines (first) and (second) the damp towels in a blind hedonic evaluation. A rating system of 0 (no malodor) to 5 (high level of malodor) was applied. The ratings of all panelists were then averaged to result in a mean average score. A part of the washed towels was directly dried in typical U.S. household dryers. The dry towels were then hedonically evaluated by using the same protocol.

It was demonstrated that the malodor reducing and freshening compositions reduced the perception of the malodor during the washing process by 40-60%. Typically, the trials were performed by washing only the towels, washing the towels in water with unscented detergent, washing the towels in water with unscented detergent by adding the synthetic malodor composition, and by washing the towels in water with unscented detergent and the synthetic malodor composition by also adding the malodor reducing and freshening compositions. There was no significant difference in malodor perception between washing only with water and washing in water with unscented detergent (ratings from 3.6 to 4.4).

When the malodor reducing and freshening compositions, based on the disclosed embodiments, were added, there was a significant drop in malodor perception (ratings from 1.8 to 2.4). The ratings for the fragrance odor were in the range of 2.9 to 3.5. This shows that the used malodor reducing and freshening compositions were able to reduce the sensorial perception of malodor during the washing process significantly but not entirely. However, together with the masking effect of the fragrance odor there is very little detectable malodor.

When the same towels were dried in the household dryers without using any additional fabric softener or fabric softener sheets, it was observed that overall the odor intensity for malodor was reduced (ratings of 2.2 to 2.5). But in the towels with the added malodor reducing and freshening compositions, based on the disclosed embodiments, malodor was further reduced (ratings of 1.0 to 1.3), with those towels having little detectable malodor as a result. The ratings for the fragrance odor were in the range of 3.7 to 4.0. In summary, this indicates that the effect of reducing the malodor through drying (without adding any fabric softener) is not only effective, but may be further accentuated by removing some of the volatile components of the synthetic malodor composition due to the elevated temperatures.

Example 2: Malodor Reduction in Drying

The synthetic malodor composition was applied in various concentrations (0.8 to 1.0 grams per towel) to the center of towels (white, 100% cotton washcloths 30 cm×30 cm) for testing. The towels were rinsed with only water in typical U.S. front-loading household washing machines (medium load is 40 towels). The washing machines were set on SPEEDWASH/COLD TEMPERATURE setting or as required. After the washing cycle was finished, panels of at least 20 experienced panelists were asked to smell the interior of the washing machines (first) and (second) the damp towels in a blind hedonic evaluation. The same rating system of 0 (no malodor) to 5 (high level of malodor) was applied. A part of the rinsed towels was then directly dried in typical U.S. household dryers by adding unscented fabric softener dryer sheets containing various concentrations of different malodor reducing and freshening compositions (typically applied at 5% onto the dryer sheet). The dry towels were then hedonically evaluated by using the same evaluators and the same protocol.

It was demonstrated again that the malodor reducing and freshening compositions, based on the disclosed embodiments, reduced the perception of the malodor during the drying process by 40-60%. Typically, the trials were performed by drying only the towels, drying the towels with unscented fabric softener dryer sheets, drying the towels with unscented fabric softener dryer sheets by adding the synthetic malodor composition, and by drying the towels with unscented unscented fabric softener dryer sheets and the synthetic malodor composition by also adding the malodor reducing and freshening compositions. There was no significant difference in malodor perception between drying with and without unscented fabric softener dryer sheets (ratings from 2.1 to 2.4). However, it was observed again that the elevated temperatures in the drying process effectively lowered the overall intensity of malodor perception. Nevertheless, when the malodor reducing and freshening compositions were added, there was again a significant drop of the malodor perception by 40-60% (ratings from 1.0 to 1.2). The ratings for the fragrance odor were in the range of 3.4 to 3.7. This indicates that the used malodor reducing and freshening compositions were able to reduce the sensorial perception of malodor in the drying process significantly but not entirely. However, together with the masking effect of the fragrance odor, very little malodor remained.

Headspace gas chromatography mass spectrometry was applied to confirm the sensory results of both the damp and dried towel experiments. Without being bound by theory, it is believed that there may be chemical interactions in the headspace that result in reductions of certain malodor components and/or in newly formed components. This was quantitatively confirmed by headspace gas chromatography, which revealed changes in certain peaks indicative of the chemical conversion of certain malodorous compounds.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Reference throughout this specification to "an embodiment"

or "one embodiment" means that a particular feature, structure, or characteristic described in connection with the embodiment is included in at least one embodiment. Thus, the appearances of the phrase "an embodiment" or "one embodiment" in various places throughout this specification are not necessarily all referring to the same embodiment.

The embodiments of the present disclosure have been described with reference to specific exemplary embodiments thereof. It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A laundry composition for malodor reduction in fabric, the composition comprising:

(A) a malodor reducing component comprising lauryl methacrylate, wherein the lauryl methacrylate is present in the composition in monomeric form; and (B) a freshening fragrance component;

wherein the laundry composition is incorporated into a solid or liquid laundry detergent, or a solid or liquid fabric softener; and the lauryl methacrylate is present in from 1 to 4% by weight of the total weight of the composition.

2. The composition of claim 1, wherein the freshening fragrance component is selected from a group consisting of adoxal (2,6,10-trimethyl-9-undecenal), aldehyde C-8, aldehyde C-9, aldehyde C-10, aldehyde C-12, amyl salicylate, anisic aldehyde, benzyl salicylate, coumarin, bourgeonal (4-t-butylbenzenepropionaldehyde), lilial (2-methyl-4-t-butylphenyl)propanal), cinnamic aldehyde, citral, cyclal (2,4-dimethyl-3-cyclohexen-1-carbaldehyde), citrathal, citronitrile, cyclacet, cyclamal, cycloprop, cyclopentadecanone, delta-damascone, dihydromyrcenol, dihydromyrcenyl acetate, dimetol, florhydral (3-(3-isopropyl-phenyl)-butyraldehyde), citronellal (3,7-dimethyl 6-octenal), cymal, cyclamen aldehyde, cyclosal, dupical (tricyclodecylidenebutanal or 4-tricyclo-5.2.1.0.-2,6-decylidene-8-butanal), dynascone, ethyl linalyl acetate, ethyl vanillin, floralozone, florhydral, helional (alpha-methyl-3,4-(methylenedioxy)-hydrocinnamaldehyde), helvetolide, gamma-heptalactone, hexyl cinnamic aldehyde, alpha-ionone, hydrocinnamaldehyde (3-phenylpropanal, 3-phenylpropionaldehyde), hydroxycitronellal, Iso E Super, karanal, lime aldehyde (alpha-methyl-p-isopropyl phenyl propyl aldehyde), lyral (4-(4-hydroxy-4-methylpentyl)-3-cyclohexene-1-carboxaldehyde), manzanate, melonal (2,6-dimethyl-5-heptenal), methoxy melonal (6-methoxy-2,6-dimethylheptanal), gamma-methylionone, methyl naphtyl ketone, methyl salicylate, methyl nonyl acetaldehyde, musk ketone, musk galaxolide, gamma-nonalactone, ozonil, phenylacetaldehyde, scentenal, spirogalbanone, tetrahydrolinalyl acetate, tetrahydromyrcenol, trans-2-decenal, triplal, vernaldehyde, vertocitral (2,4-dimethyl-3-cyclohexene-1-carboxaldehyde), Verdox, yara yara, and combinations thereof.

3. A method of reducing malodor in fabric, the method comprising:

applying a composition for malodor reduction onto a fabric, the composition comprising lauryl methacrylate, wherein the lauryl methacrylate is present in the composition in monomeric form; and drying the fabric.

4. The method of claim 3, further comprising:

washing the fabric subsequent to applying the composition onto the fabric and prior to drying the fabric.

5. The method of claim 3, wherein the composition for malodor reduction further comprises a freshening fragrance component selected from a group consisting of adoxal (2,6,10-trimethyl-9-undecenal), aldehyde C-8, aldehyde C-9, aldehyde C-10, aldehyde C-12, amyl salicylate, anisic aldehyde, benzyl salicylate, coumarin, bourgeonal (4-t-butylbenzenepropionaldehyde), lilial (2-methyl-4-t-butylphenyl)propanal), cinnamic aldehyde, citral, cyclal (2,4-dimethyl-3-cyclohexen-1-carbaldehyde), citrathal, citronitrile, cyclacet, cyclamal, cycloprop, cyclopentadecanone, delta-damascone, dihydromyrcenol, dihydromyrcenyl acetate, dimetol, florhydral (3-(3-isopropyl-phenyl)-butyraldehyde), citronellal (3,7-dimethyl 6-octenal), cymal, cyclamen aldehyde, cyclosal, dupical (tricyclodecylidenebutanal or 4-tricyclo-5.2.1.0.-2,6-decylidene-8-butanal), dynascone, ethyl linalyl acetate, ethyl vanillin, floralozone, florhydral, helional (alpha-methyl-3,4-(methylenedioxy)-hydrocinnamaldehyde), helvetolide, gamma-heptalactone, hexyl cinnamic aldehyde, alpha-ionone, hydrocinnamaldehyde (3-phenylpropanal, 3-phenylpropionaldehyde), hydroxycitronellal, Iso E Super, karanal, lime aldehyde (alpha-methyl-p-isopropyl phenyl propyl aldehyde), lyral (4-(4-hydroxy-4-methylpentyl)-3-cyclohexene-1-carboxaldehyde), manzanate, melonal (2,6-dimethyl-5-heptenal), methoxy melonal (6-methoxy-2,6-dimethylheptanal), gamma-methylionone, methyl naphtyl ketone, methyl salicylate, methyl nonyl acetaldehyde, musk ketone, musk galaxolide, gamma-nonalactone, ozonil, phenylacetaldehyde, scentenal, spirogalbanone, tetrahydrolinalyl acetate, tetrahydromyrcenol, trans-2-decenal, triplal, vernaldehyde, vertocitral (2,4-dimethyl-3-cyclohexene-1-carboxaldehyde), Verdox, yara yara, and combinations thereof.

6. A dryer sheet for reducing malodors from fabric, the dryer sheet comprising:

a substrate having additives incorporated thereon, the additives comprising:

(A) a malodor reducing component comprising lauryl methacrylate, wherein the lauryl methacrylate is present in monomeric form; and (B) a freshening fragrance component;

wherein the lauryl methacrylate is present in from 1 to 4% by weight of the total weight of the composition.

7. The dryer sheet of claim 6, wherein the freshening fragrance component is selected from a group consisting of adoxal (2,6,10-trimethyl-9-undecenal), aldehyde C-8, aldehyde C-9, aldehyde C-10, aldehyde C-12, amyl salicylate, anisic aldehyde, benzyl salicylate, coumarin, bourgeonal (4-t-butylbenzenepropionaldehyde), lilial (2-methyl-4-t-butylphenyl)propanal), cinnamic aldehyde, citral, cyclal (2,4-dimethyl-3-cyclohexen-1-carbaldehyde), citrathal, citronitrile, cyclacet, cyclamal, cycloprop, cyclopentadecanone, delta-damascone, dihydromyrcenol, dihydromyrcenyl acetate, dimetol, florhydral (3-(3-isopropyl-phenyl)-butyraldehyde), citronellal (3,7-dimethyl 6-octenal), cymal, cyclamen aldehyde, cyclosal, dupical (tricyclodecylidenebutanal or 4-tricyclo-5.2.1.0.-2,6-decylidene-8-butanal), dynascone, ethyl linalyl acetate, ethyl vanillin, floralozone, florhydral, helional (alpha-methyl-3,4-(methylenedioxy)-hydrocinnamaldehyde), helvetolide, gamma-heptalactone, hexyl cinnamic aldehyde, alpha-ionone, hydrocinnamaldehyde (3-phenylpropanal, 3-phenylpropionaldehyde), hydroxycitronellal, Iso E Super, karanal, lime aldehyde (alpha-methyl-p-isopropyl phenyl propyl aldehyde), lyral (4-(4-hydroxy-4-methylpentyl)-3-cyclohexene-1-carboxaldehyde), manzanate, melonal (2,6-dimethyl-5-heptenal), methoxy melonal (6-methoxy-2,6-dimethylheptanal), gamma-methylionone, methyl naphtyl ketone, methyl salicylate, methyl nonyl acetaldehyde, musk ketone, musk galaxolide, gamma-nonalactone, ozonil, phenylacetaldehyde, scentenal, spirogalbanone, tetrahydrolinalyl acetate, tetrahydromyrcenol, trans-2-decenal, triplal, vernaldehyde, vertocitral (2,4-dimethyl-3-cyclohexene-1-carboxaldehyde), Verdox, yara yara, and combinations thereof.

8. A laundry composition for malodor reduction in fabric, the composition comprising:

(A) a malodor reducing component comprising lauryl methacrylate, wherein the lauryl methacrylate is present in the composition in monomeric form; and (B) a freshening fragrance component comprising one or more of aldehyde compounds, ketone compounds, or ester compounds;

wherein the laundry composition is incorporated into a solid or liquid laundry detergent, or a solid or liquid fabric softener;

wherein the lauryl methacrylate is present in from 1 to 4% by weight of the total weight of the composition.

9. The composition of claim 8, wherein the freshening fragrance component comprises aldehyde compounds, ester compounds, and ketone compounds.

10. The composition of claim 9, wherein the aldehyde compounds are present in an amount from 1% to 40% by weight based on a total weight of the freshening fragrance component, and wherein the ester compounds are present in an amount from 15% to 50% by weight based on the total weight of the freshening fragrance component.

11. The composition of claim 9, wherein the ester compounds are present in an amount from 15% to 50% by weight based on a total weight of the freshening fragrance component, and wherein the ketone compounds are present in an amount from 3% to 35% by weight based on the total weight of the freshening fragrance component.

* * * * *